US007819502B2

(12) United States Patent
Enomoto et al.

(10) Patent No.: US 7,819,502 B2
(45) Date of Patent: Oct. 26, 2010

(54) LIQUID EJECTION HEAD AND IMAGE FORMING APPARATUS

(75) Inventors: Katsumi Enomoto, Kanagawa-ken (JP); Michiaki Murata, Ebina (JP); Yasuhiko Maeda, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 882 days.

(21) Appl. No.: 11/716,570

(22) Filed: Mar. 12, 2007

(65) Prior Publication Data

US 2007/0211109 A1 Sep. 13, 2007

(30) Foreign Application Priority Data

Mar. 13, 2006 (JP) ..... 2006-067851

(51) Int. Cl.
*B41J 2/14* (2006.01)
*B41J 2/16* (2006.01)

(52) U.S. Cl. ..... 347/50; 347/20; 347/40; 347/44; 347/47; 347/68

(58) Field of Classification Search ..... 347/50, 347/68

See application file for complete search history.

(56) References Cited

U.S. PATENT DOCUMENTS 5,889,539 A * 3/1999 Kamoi et al. ..... 347/50
6,341,845 B1 * 1/2002 Scheffelin et al. ..... 347/50
7,419,237 B2 * 9/2008 Suzuki ..... 347/18
7,438,389 B2 * 10/2008 Katayama ..... 347/50

FOREIGN PATENT DOCUMENTS

JP 9-314831 A 12/1997
JP 9-314833 A 12/1997

* cited by examiner

*Primary Examiner*—Ryan Lepisto
(74) *Attorney, Agent, or Firm*—Birch, Stewart, Kolasch & Birch, LLP

(57) ABSTRACT

The liquid ejection head includes: a plurality of pressure chambers into which liquid is filled; a plurality of nozzles which are connected to the pressure chambers; a common flow channel which supplies the liquid to the pressure chambers; a plurality of liquid ejection devices which cause the liquid inside the pressure chambers to be ejected through the nozzles; a selector circuit which selects one of the liquid ejection devices to be a destination of a drive signal; a first wiring substrate which transmits the drive signal outputted from the selector circuit to be applied to the one of the liquid ejection devices; and a second wiring substrate which transmits the drive signal to be inputted to the selector circuit, wherein the first wiring substrate is connected to a first face of a member constituting the selector circuit, and the second wiring substrate is connected to a second face of the member constituting the selector circuit, the first and second faces being different to each other.

6 Claims, 11 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly to a liquid ejection head and an image forming apparatus which eject ink droplets from nozzles by driving liquid ejection devices, such as piezoelectric elements.

2. Description of the Related Art

In recent years, image forming apparatuses based on an inkjet system (i.e., inkjet recording apparatuses), which record desired images on recording media by ejecting ink from heads having a plurality of nozzles (i.e., liquid ejection heads), have come to be widely used. In these heads, each of the nozzles is provided with a liquid ejection device, which is typically a piezoelectric element or a heating element, and ink droplets are ejected from the nozzles by selectively driving the liquid ejection devices.

There are the inkjet recording apparatuses in which a selector circuit for selecting the liquid ejection device to which a drive signal is to be applied, is constituted separately from the head, and the selector circuit is connected to the head through a flexible printed circuit (FPC). However, it is technically difficult to reduce the wiring pitch in the flexible printed circuits, and hence there are limitations on the increase in the nozzle density in the head that can be achieved. Furthermore, there is also a problem in that high-density flexible printed circuits are expensive.

In view of the above-described problems, Japanese Patent Application Publication No. 9-314833, for example, discloses a head in which, rather than using the flexible printed circuit, thin film transistor (TFT) elements of equal number to the piezoelectric elements are arranged on a side wall of a reservoir corresponding to a common flow channel (i.e., on a drive substrate). In this head, however, the wires arranged on the drive substrate start from the face on which the thin film transistor elements are arranged, and stretch along another face perpendicular to the former face, and hence complicated manufacturing steps are required and reliability declines. Moreover, the wires of the drive substrate are connected directly to the piezoelectric element terminals, and this composition is technically very difficult. Furthermore, in order to ensure reliability, it is necessary to increase the size of the head by increasing the thickness of the wires, or the like, and this leads to problems of additional costs.

Japanese Patent Application Publication No. 9-314831 discloses a head in which an integrated circuit (IC) chip and wires are arranged on a covering member that covers three faces of the main body of the head. In this head, however, both the signal wires and the control signal wires arranged on the covering member are connected to the same face of the IC chip, and there is no prospect of reducing the installation surface area on the cover member. Moreover, it is technically difficult to connect the cover member to the three faces of the main body of the head. Furthermore, Japanese Patent Application Publication No. 9-314831 discloses that a low-density connection method using soldering, or the like, is used for connecting the electric terminals on the cover member with the electric terminals on the main body of the head; however, this is not suitable for high-density connections. Consequently, similarly to Japanese Patent Application Publication No. 9-314833, there are problems in that this leads to increased size of the head and increased costs.

In order to ensure the reliability of the connections, it is necessary to reduce the high-density connection sections (from the IC to the piezoelectric element side). It is hence desirable to install the IC on the head, also from the viewpoint of reducing the number of components; however, this incurs increased size of the head in order to ensure sufficient installation surface area.

SUMMARY OF THE INVENTION

The present invention has been contrived in view of the foregoing circumstances, an object thereof being to provide a liquid ejection head and image forming apparatus in which the size and cost of the head can be reduced, while improving reliability.

In order to attain the aforementioned object, the present invention is directed to a liquid ejection head, comprising: a plurality of pressure chambers into which liquid is filled; a plurality of nozzles which are connected to the pressure chambers; a common flow channel which supplies the liquid to the pressure chambers; a plurality of liquid ejection devices which cause the liquid inside the pressure chambers to be ejected through the nozzles; a selector circuit which selects one of the liquid ejection devices to be a destination of a drive signal; a first wiring substrate which transmits the drive signal outputted from the selector circuit to be applied to the one of the liquid ejection devices; and a second wiring substrate which transmits the drive signal to be inputted to the selector circuit, wherein the first wiring substrate is connected to a first face of a member constituting the selector circuit, and the second wiring substrate is connected to a second face of the member constituting the selector circuit, the first and second faces being different to each other.

According to this aspect of the present invention, by connecting the first wiring substrate to one face of the member constituting the selector circuit installed in the liquid ejection head, and by connecting the second wiring substrate to one face of the member other than the face to which the first wiring substrate is connected, it is possible to reduce the installation surface area of the second wiring substrate, and therefore the liquid ejection head can be made compact in size. Moreover, since the wiring density of the second wiring substrate can be low (i.e., the wiring pitch can be large), then production yield improves and costs can be reduced. Furthermore, due to the simplified composition of the connections, reliability is improved.

Preferably, the first wiring substrate is disposed between the pressure chamber and the common flow channel.

According to this aspect of the present invention, it is possible to connect the first wiring substrate and the respective piezoelectric elements directly, and adaptation to a high-density configuration based on a two-dimensional (matrix) nozzle arrangement is also possible.

Preferably, the second wiring substrate constitutes a wall of the common flow channel.

According to this aspect of the present invention, if a flexible substrate is used for the second wiring substrate, then it functions as a damper for reducing the pressure wave propagated through the liquid inside the common flow channel, and therefore cross-talk in the liquid can be prevented. Furthermore, since the selector circuit can radiate heat through the liquid inside the common flow channel, then the operation of the selector circuit is stabilized, and on the other hand, since the temperature of the liquid inside the common flow channel can be adjusted by means of the heat generated by the selector circuit, then ejection stability is improved. Moreover, by adopting members having shared use, the number of components is reduced and cost benefits are also obtained.

Preferably, the member constituting the selector circuit constitutes a wall of the common flow channel.

According to this aspect of the present invention, the heat radiating effect of the selector circuit is further enhanced.

In order to attain the aforementioned object, the present invention is also directed to an image forming apparatus comprising the above-described liquid ejection head.

According to the present invention, by connecting the first wiring substrate to one face of the member constituting the selector circuit installed in the liquid ejection head, and by connecting the second wiring substrate to one face of the member other than the face to which the first wiring substrate is connected, it is possible to reduce the installation surface area of the second wiring substrate, and therefore the liquid ejection head can be made compact in size. Moreover, since the wiring density of the second wiring substrate can be low (i.e., the wiring pitch can be large), then production yield improves and costs can be reduced. Furthermore, due to the simplified composition of the connections, reliability is improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
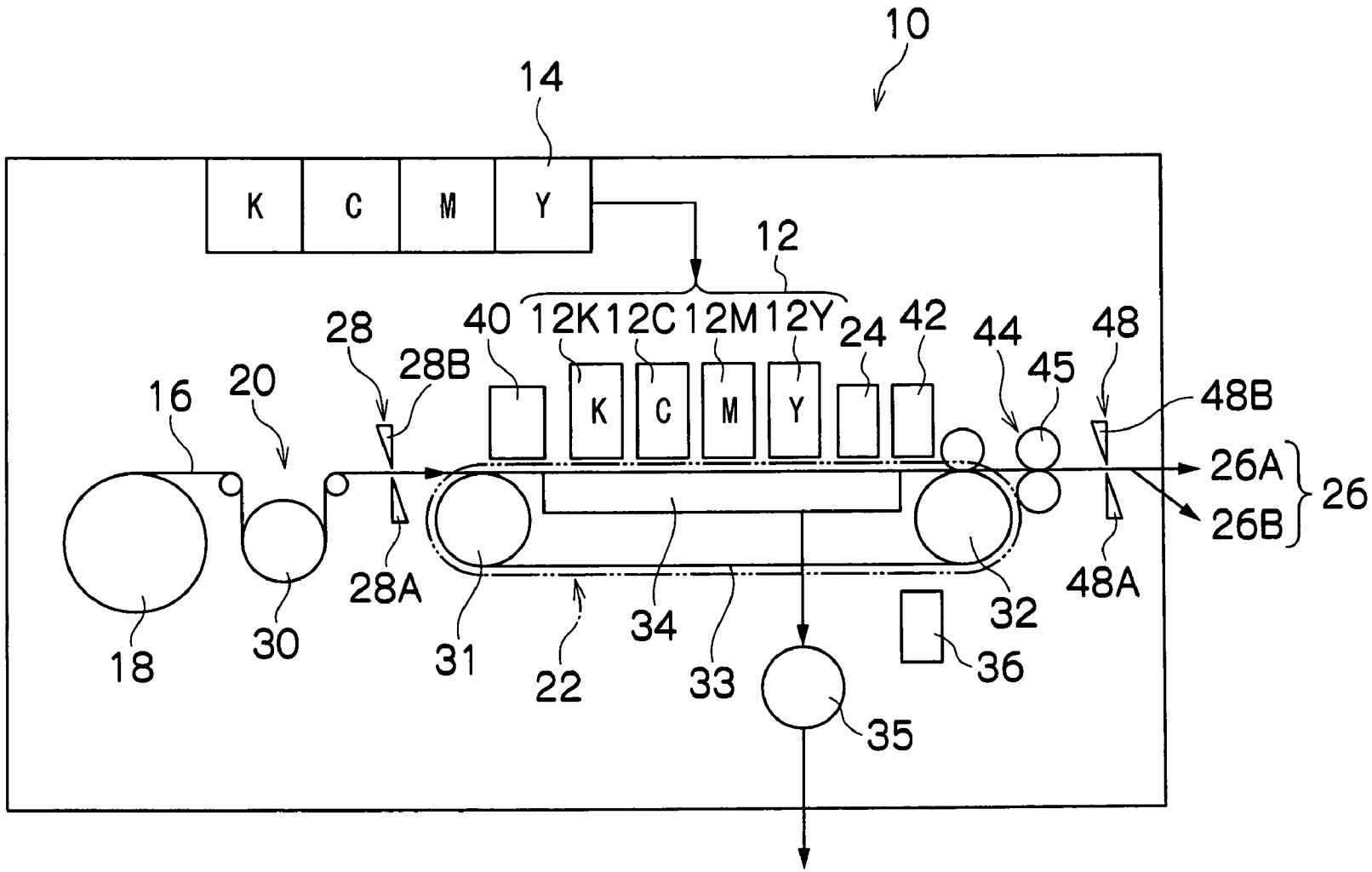
FIG. 1 is a general compositional view showing an inkjet recording apparatus according to a first embodiment of the present invention.

FIG. 1 is a diagram of the general composition showing a schematic view of an inkjet recording apparatus as an image forming apparatus according to an embodiment of the present invention. As shown in FIG. 1, the inkjet recording apparatus 10 has: a printing unit 12 having a plurality of heads 12K, 12C, 12M, and 12Y for ink colors of black (K), cyan (C), magenta (M), and yellow (Y), respectively; an ink storing and loading unit 14 for storing inks of K, C, M, and Y to be supplied to the heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping of a brush roller and a water absorbent roller, an air blow configuration in which clean air is blown, or a combination of these. In the case of the configuration of nipping of the cleaning rollers, it is preferable to make the line velocity of the cleaning rollers different than that of the belt 33 to improve the cleaning effect.

The inkjet recording apparatus 10 can have a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). Each of the heads 12K, 12C, 12M, and 12Y, which constitute the print unit 12, is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (right-hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

By adopting a configuration for the print unit 12 in which the full line head covering the full paper width is provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in the direction perpendicular to the paper conveyance direction (main scanning direction).

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 1, the ink storing and loading unit 14 has ink tanks for storing the inks of the colors corresponding to the respective heads 12K, 12C, 12M, and 12Y, and the respective tanks are connected to the heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements arranged two-dimensionally.

The print determination unit 24 reads a test pattern image printed by the heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in drawings, the paper output unit 26A for the target prints is provided with a sorter for collecting prints according to print orders.

Figure 2:
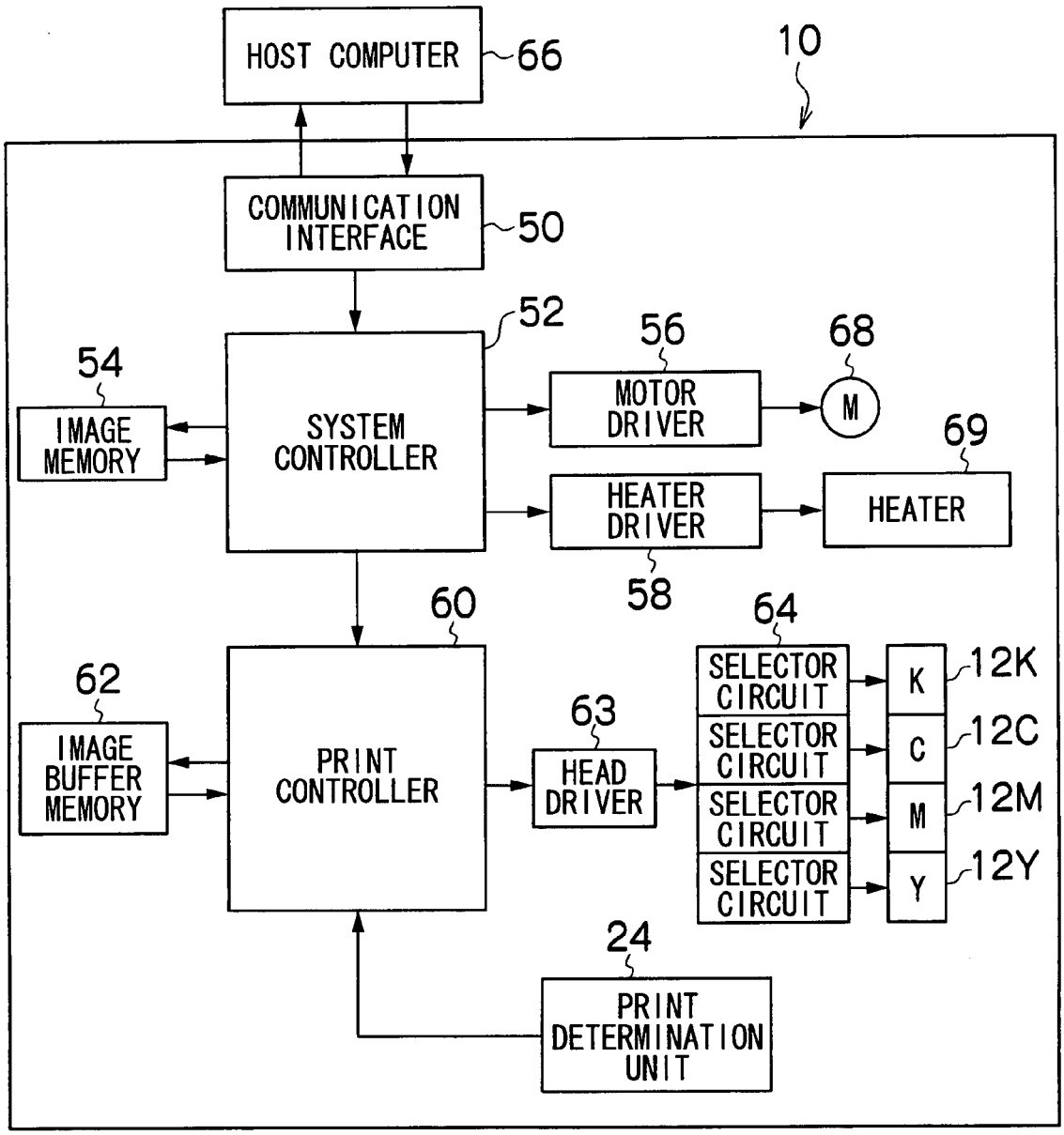
FIG. 2 is a principal block diagram showing a system composition of the inkjet recording apparatus.

Next, a control system for the inkjet recording apparatus 10 is described. FIG. 2 is a principal block diagram showing the system configuration of the inkjet recording apparatus 10. The inkjet recording apparatus 10 has a communication interface 50, a system controller 52, an image memory 54, a motor driver 56, a heater driver 58, a print controller 60, an image buffer memory 62, a head driver (a drive circuit) 63, a selector circuit 64 and the like.

The communication interface 50 is an interface unit for receiving image data sent from a host computer 66. A serial interface or a parallel interface may be used as the communication interface 50. A buffer memory (not shown) may be mounted in this portion in order to increase the communication speed.

The image data sent from the host computer 66 is received by the inkjet recording apparatus 10 through the communication interface 50, and is temporarily stored in the image memory 54. The image memory 54 is a storage device for temporarily storing images inputted through the communication interface 50, and data is written and read to and from the image memory 54 through the system controller 52. The image memory 54 is not limited to a memory composed of semiconductor elements, and a hard disk drive or another magnetic medium may be used.

The system controller 52 is a control unit for controlling the various sections, such as the communication interface 50, the image memory 54, the motor driver 56, the heater driver 58, and the like. The system controller 52 is constituted by a central processing unit (CPU) and peripheral circuits thereof, and the like, and in addition to controlling communications with the host computer 66 and controlling reading and writing from and to the image memory 54, or the like, it also generates a control signal for controlling a motor 68 of the conveyance system and a heater 69.

The motor driver (drive circuit) 56 drives the motor 68 in accordance with commands from the system controller 52. The heater driver 58 drives the heater 69 of the post-drying unit 42 and the like in accordance with commands from the system controller 52.

The print controller 60 is a control unit having a signal processing function for performing various treatment processes, corrections, and the like, in accordance with the control implemented by the system controller 52, in order to generate a signal for controlling printing from the image data in the image memory 54. The print controller 60 applies the print control signal (dot data) thus generated to the head driver (drive circuit) 63. Prescribed signal processing is carried out in the print controller 60, the head driver 63 generates drive signals on the basis of the image data, and the ejection amount and the ejection timing of ink droplets from the print heads 12K, 12C, 12M, and 12Y are controlled through the respective selector circuits 64 corresponding to the print heads. By this means, prescribed dot sizes and dot positions can be achieved.

The print controller 60 is provided with the image buffer memory 62; and image data, parameters, and other data are temporarily stored in the image buffer memory 62 when image data is processed in the print controller 60. The aspect shown in FIG. 2 is one in which the image buffer memory 62 accompanies the print controller 60; however, the image memory 54 may also serve as the image buffer memory 62. Also possible is an aspect in which the print controller 60 and the system controller 52 are integrated to form a single processor.

The head driver 63 generates drive signals on the basis of the dot data supplied by the print controller 60, and the selector circuits 64 select particular piezoelectric elements 88 (not shown in FIG. 2, but shown in FIG. 5) of the heads of the respective colors 12K, 12C, 12M, and 12Y, and apply the drive signals to the selected piezoelectric elements 88. A feedback control system for maintaining constant drive conditions for the heads 12K, 12C, 12M, and 12Y, may be included in the head driver 63. Furthermore, the head driver 63 and the selector circuits 64 may be integrated and composed in a single IC.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 60. According to requirements, the print controller 60 makes various corrections with respect to the heads 12K, 12C, 12M, and 12Y on the basis of information obtained from the print determination unit 24.

Next, the structure of the heads 12K, 12C, 12M, and 12Y is described. The heads 12K, 12C, 12M, and 12Y corresponding to the respective colors have the same structure, and hereinafter, reference numeral 70 is used to denote a representative embodiment of the heads.

Figure 3:
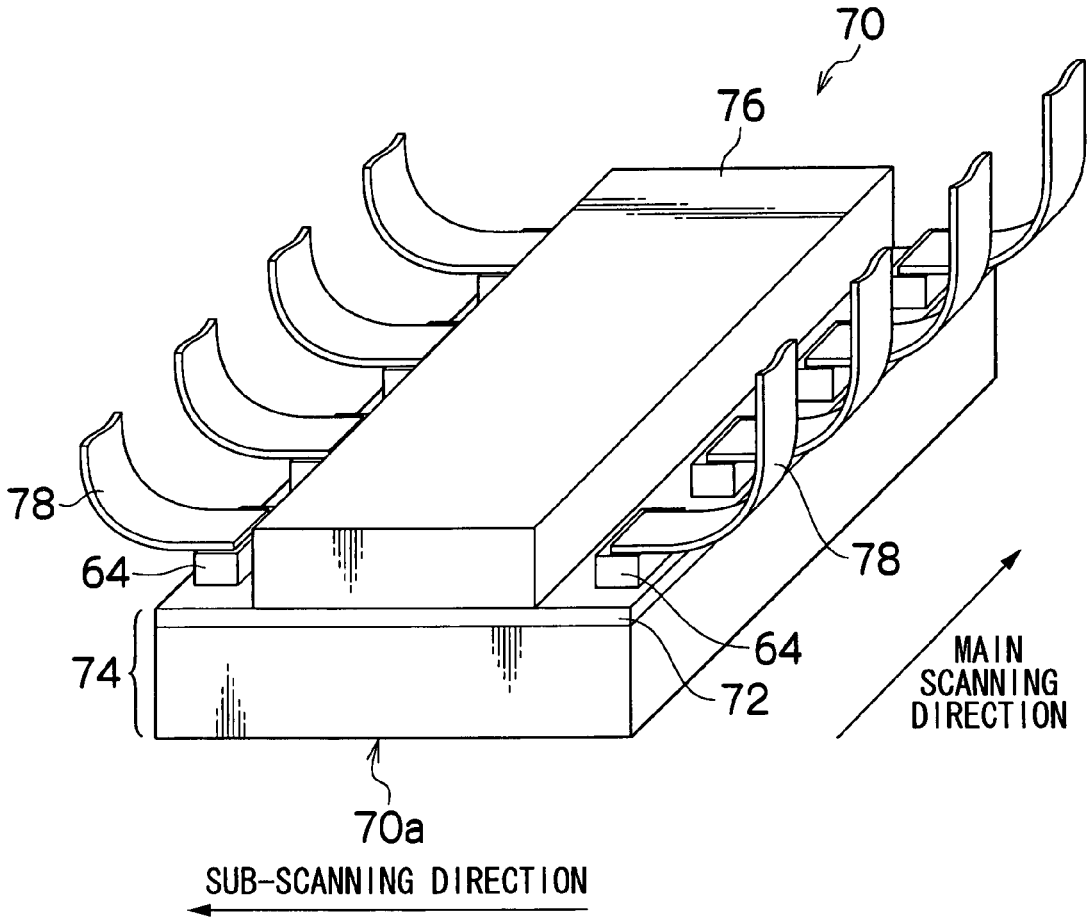
FIG. 3 is an external oblique diagram of a head according to the first embodiment.
Figure 4:
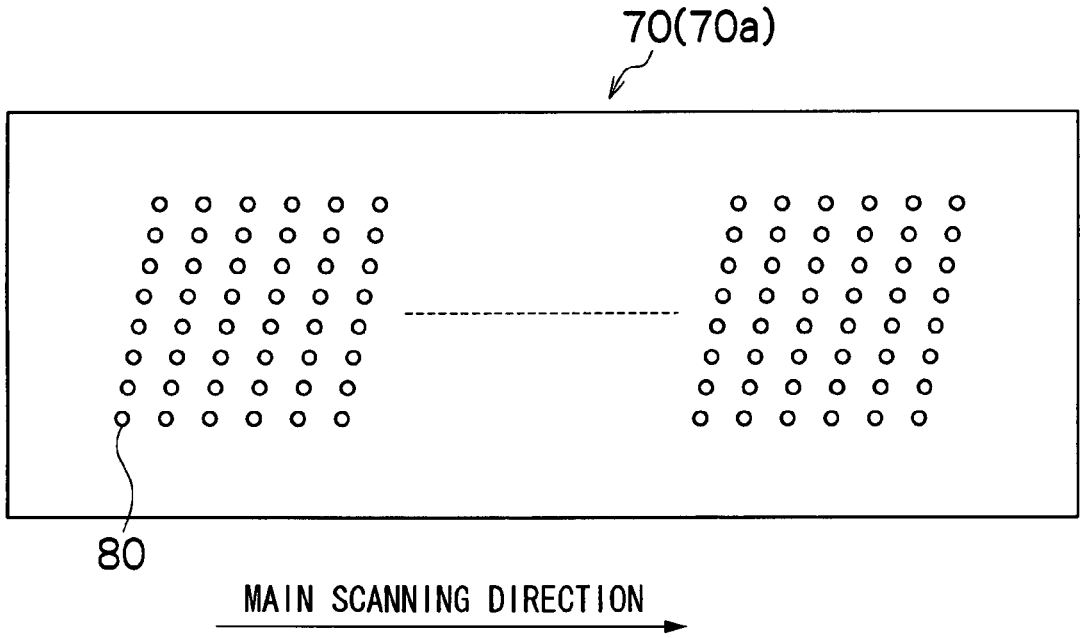
FIG. 4 is a plan diagram showing the nozzle face of the head according to the first embodiment.
Figure 5:
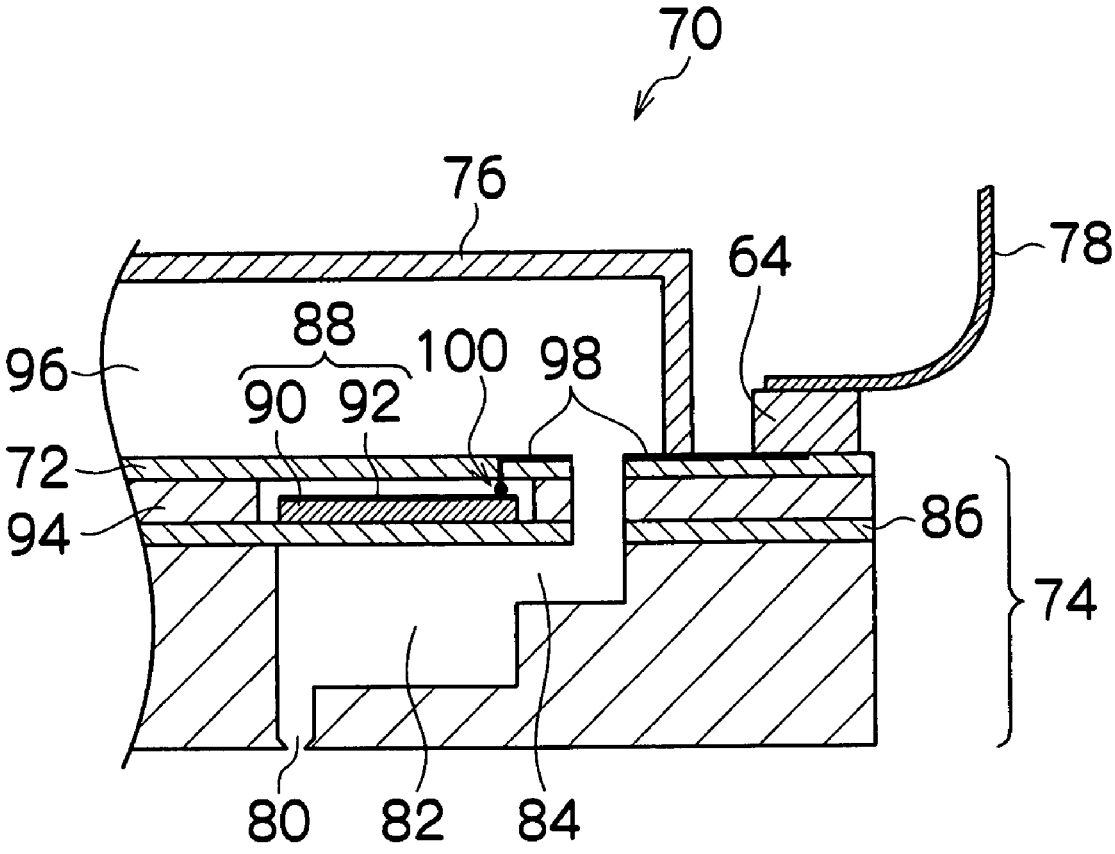
FIG. 5 is a partial cross-sectional diagram showing the internal structure of the head according to the first embodiment.

FIG. 3 is an external perspective diagram of the head 70, FIG. 4 is a plan diagram showing a nozzle face 70*a* of the head 70, and FIG. 5 is a partial cross-sectional diagram showing the internal structure of the head 70.

As shown in FIG. 3, the head 70 is principally composed of: a head main body 74 including a first wiring substrate 72, a common flow channel forming member 76, a plurality of selector circuits 64, and a plurality of second wiring substrates 78. In the present embodiment, flexible printed circuits (FPC) are used as the second wiring substrates 78. The selector circuits 64 are arranged on the first wiring substrate 72 along sides of the common flow channel forming member 76 following the main scanning direction, and more specifically in the present embodiment, four of the selector circuits 64 are arranged along each of the two long sides of the common flow channel forming member 76. There are modes of members constituting the selector circuits 64 in which each selector circuit 64 constituted of an integrated circuit (IC), or each selector circuit 64 including a circuit board on which the selector circuit 64 is mounted, but it is of course not limited to these modes. Below, the "member constituting the selector circuit 64" is simply called the "selector circuit 64". Connection terminals (bumps) (not shown) are formed on the upper and lower faces of the selector circuits 64 (or the members forming same), and the first and second wiring substrates 72 and 78 are installed on the selector circuits 64 by means of a flip-chip mount.

As shown in FIG. 4, a plurality of nozzles 80 forming ink ejection ports are arranged in a two-dimensional configuration (matrix configuration) following the main scanning direction and an oblique direction with respect to the main scanning direction, on the nozzle face 70*a* of the head 70. Although not shown in the drawings, a composition is adopted whereby the projected nozzle row obtained by projecting the respective nozzles 80 to a linear alignment following the main scanning direction has the projected nozzles arranged equidistantly at uniform nozzle pitch, and consequently, a high resolution is achieved for the dot pitch on the recording medium 16.

As shown in FIG. 5, pressure chambers 82 connected to the nozzles 80 are arranged inside the head 70. A supply port 84 through which the ink is supplied is provided at one end of each pressure chamber 82. One wall of the pressure chamber 82 is constituted by a diaphragm 86, and a piezoelectric element 88 is installed on the diaphragm 86 at a position corresponding to the pressure chamber 82. The piezoelectric element 88 has a structure in which an individual electrode (drive electrode) 92 is arranged on the upper surface of a thin film-shaped piezoelectric body 90. The diaphragm 86 is made of a conductive member of stainless steel, or the like, and also serves as a common electrode for the piezoelectric elements 88. There is also a mode in which the diaphragm 86 is made of a non-conductive member, and an electrode layer serving as the common electrode is provided on the surface on which the piezoelectric elements 88 are installed.

The first wiring substrate 72 and a spacer 94 formed with through hole sections to accommodate the piezoelectric elements 88 are installed on the piezoelectric element 88 side of the diaphragm 86, and furthermore, a common flow channel 96 is defined on the upper side of same. In other words, the diaphragm 86, the spacer 94, and the first wiring substrate 72 are arranged between the common flow channel 96 and the pressure chambers 82. The upper wall and the side walls of the common flow channel 96 are constituted by the common flow channel forming member 76, and the lower wall is constituted by the first wiring substrate 72. The common flow channel 96 is connected to the respective pressure chambers 82 through the respective supply ports 84 of the pressure chambers 82. The ink supplied from the ink storing and loading unit 14 shown in FIG. 1 is stored in the common flow channel 96, and is then distributed and supplied to the respective pressure chambers 82 from the common flow channel 96.

Wires 98 of the same number as the number of the piezoelectric elements 88 are provided on the first wiring substrate 72, and one end of each wire 98 is connected through an electrical connection section 100 to the individual electrode 92 of the corresponding piezoelectric element 88. The electrical connection sections 100 are made of solder or a conductive paste, for example. On the other hand, the other ends of the wires 98 stretch from positions corresponding to the piezoelectric elements 88 to the installation positions of the selector circuits 64 on the side end portions of the first wiring substrate 72, and the lower surfaces of the selector circuits 64 are installed on the first wiring substrate 72 by means of a flip-chip mount. Furthermore, the second wiring substrates 78 are installed on the upper surfaces of the selector circuits 64 by means of a flip-chip mount. An insulating and protective film (not shown) made of resin, or the like, is provided on the surface of the first wiring substrate 72 adjacent to the common flow channel 96, in order to prevent the wires 98 from making contact with the ink inside the common flow channel 96.

The other ends of the second wiring substrates 78 are connected to the head driver 63 (not shown in FIG. 5; see FIG. 2), and the drive signals generated by the head driver 63 on the basis of the dot data generated by the print controller 60 are inputted to the selector circuits 64 through the second wiring substrates 78. In the selector circuit 64, a particular piezoelectric element 88 that is the application destination of the input drive signal is selected, and the drive signal is outputted to the wire 98 on the first wiring substrate 72 corresponding to the particular piezoelectric element 88. In this way, the drive signal is applied to the piezoelectric element 88.

When the drive signal is applied to the piezoelectric element 88, the diaphragm 86 is caused to deform and bend toward the pressure chamber 82 due to the deformation of the piezoelectric element 88, thereby reducing the volume of the pressure chamber 82. Consequently, the ink inside the pressure chamber 82 is pressurized and a droplet of the ink is thus ejected from the nozzle 80. After the ink ejection, the ink is refilled into the pressure chamber 82 from the common flow channel 96.

Figure 6A:
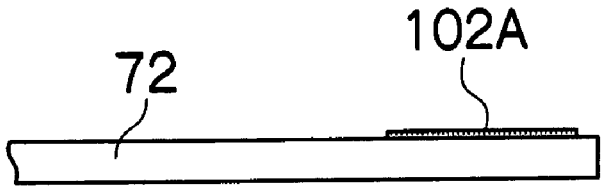
FIGS. 6A to 6D are illustrative diagrams showing a method of connecting a selector circuit according to the first embodiment.
Figure 6B:
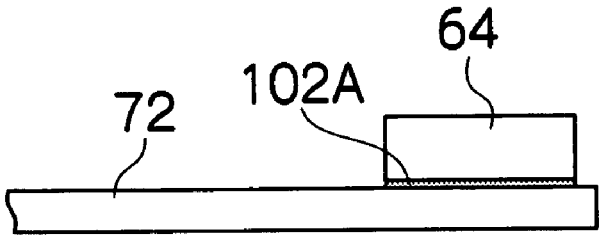
Figure 6C:
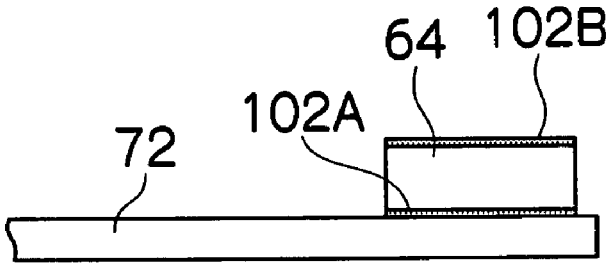
Figure 6D:
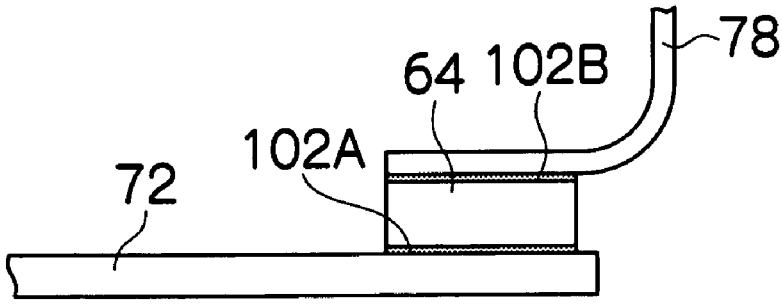

Next, the method of connecting the first and second wiring substrates 72 and 78 to the selector circuits 64 is described with reference to FIGS. 6A to 6D. Firstly, as shown in FIG. 6A, a connecting material 102A, such as anisotropic conductive film (ACF), anisotropic conductive paste (ACP), non-conductive particle paste (NCP), or the like, is applied onto the side of the end portion of the first wiring substrate 72 on which the wires 98 (not shown in FIGS. 6A to 6D) have already been formed. Next, as shown in FIG. 6B, the first wiring substrate 72 is connected to the lower face of the selector circuit 64 through the connecting material 102A therebetween. The connection method uses a flip-chip mount. In the flip-chip mount, the connection is made by means of so-called thermal compression bonding, by applying pressure suitable to the connection material 102A at a temperature suitable to the connection material 102A. For example, the flip-chip mount is achieved by applying a pressure of 3 MPa at a temperature of 100° C. to 200° C. for three minutes. Thereupon, as shown in FIG. 6C, a connection material 102B is applied onto the selector circuit 64. The same material as the connection material 102A may also be used for the connection material 102B, and the material used for the connection material 102B should be one having a lower connection temperature than the connection temperature of the connection material 102A used for the previous connection. Finally, as shown in FIG. 6D, the second wiring substrate 78 is connected to the upper face of the selector circuit 64 through the connecting material 102B therebetween. The connection method is similar to that used when connecting the first wiring substrate 72 to the lower face of the selector circuit 64. In this way, the first and second wiring substrates 72 and 78 are connected to the upper and lower faces of the selector circuit 64.

There are no particular limitations on the connection sequence of the first and second wiring substrates 72 and 78, and it is possible to connect the first wiring substrate 72 to the selector circuit 64 after connection of the second wiring substrate 78 to the selector circuit 64. In this case, the material selected for the connection material 102A that is used in the second connection should have the connection temperature that is lower than the connection temperature of the connection material 102B that is used in the first connection.

According to the first embodiment, by adopting the composition in which the first and second wiring substrates 72 and 78 are connected to the upper and lower faces of the selector circuits 64, there is no need to provide space for mounting the second wiring substrates 78 above the first wiring substrate 72, and therefore the head size can be made more compact. Furthermore, it is possible to reduce the number of wires in the second wiring substrates (FPC) 78 in comparison with the number of wires in the first wiring substrate 72, and consequently, the wiring density of the second wiring substrate 78 can be low (i.e., the wiring pitch can be large). Therefore, the production yield can be improved, the costs can be reduced, and the reliability is improved due to the simplified composition of the connections.

Second Embodiment

Next, a second embodiment of the present invention is described. Below, the parts of the second embodiment that are common to the above-described first embodiment are not described, and the explanation focuses on the characteristic features of the second embodiment.

Figure 7:
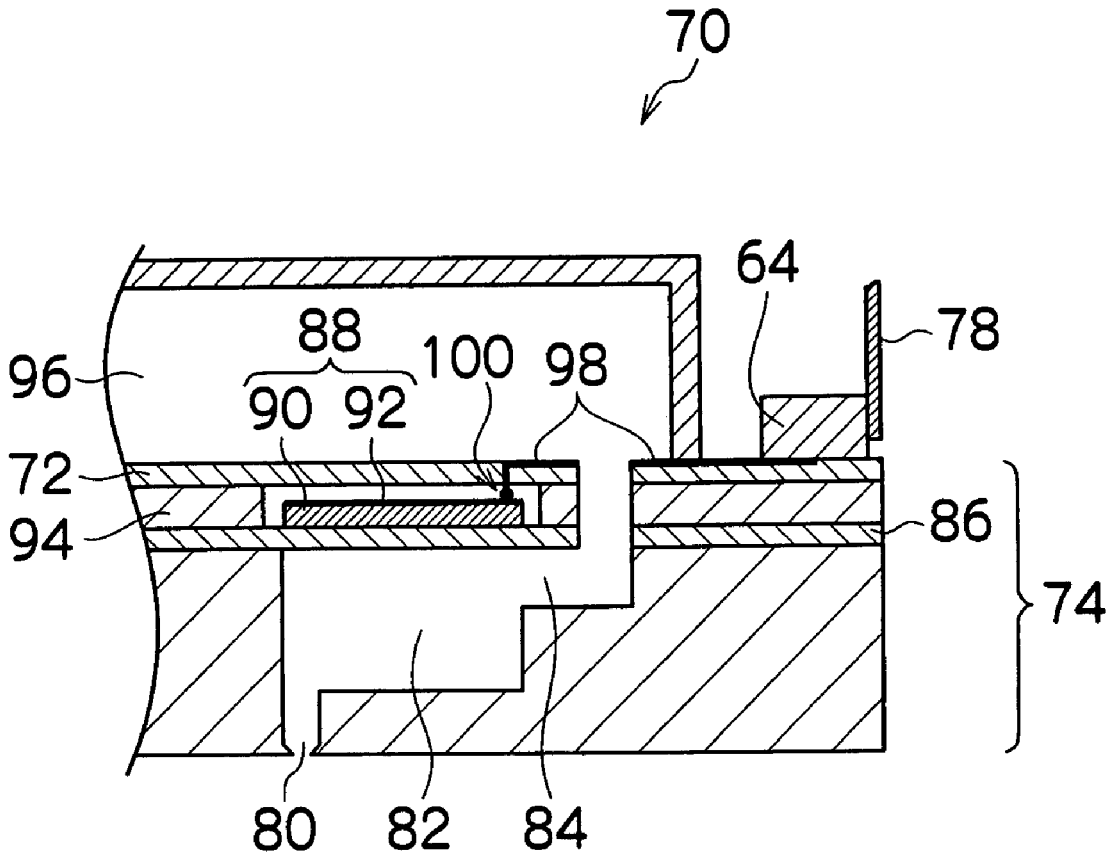
FIG. 7 is a partial cross-sectional diagram of the head according to a second embodiment.

FIG. 7 is a partial cross-sectional diagram of a head 70 according to the second embodiment. In FIG. 7, the members that are common to those in FIG. 5 are denoted with the same reference numerals. As shown in FIG. 7, the present embodiment is a mode in which the first and second wiring substrates 72 and 78 are connected to the lower face and the side face of the selector circuit 64.

Figure 8A:
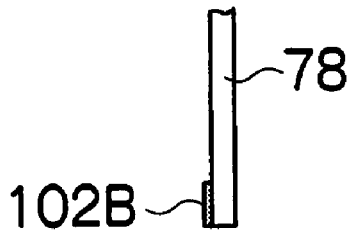
FIGS. 8A to 8C are illustrative diagrams showing a method of connecting the selector circuit according to the second embodiment.
Figure 8B:
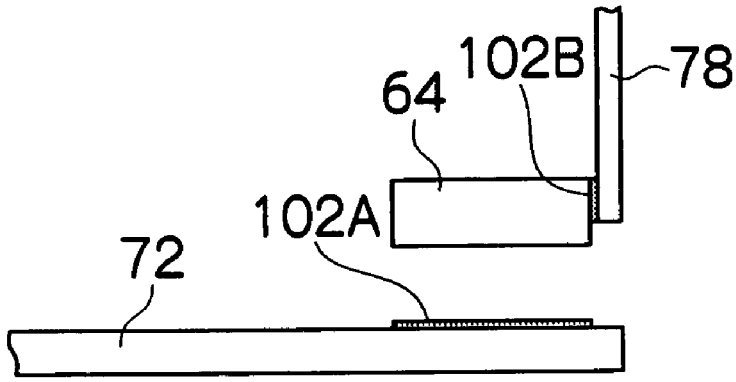
Figure 8C:
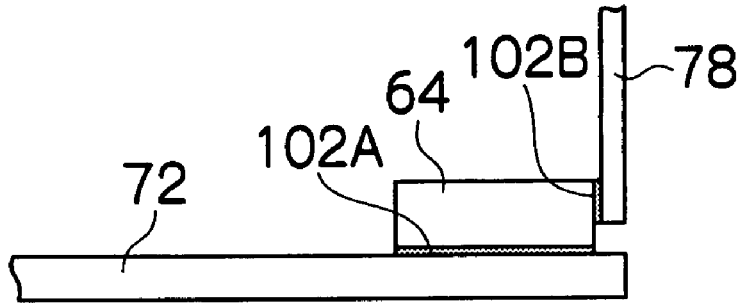

Next, the method of connecting the first and second wiring substrates 72 and 78 to the selector circuit 64 is described with reference to FIGS. 8A to 8C. Firstly, as shown in FIG. 8A, the connection material 102B is applied onto one end of the second wiring substrate 78. Thereupon, as shown in FIG. 8B, the second wiring substrate 78 is connected to the side face of the selector circuit 64 through the connection material 102B therebetween, and furthermore, the connection material 102A is applied onto the first wiring substrate 72, on an end portion at a position where the selector circuit 64 is to be installed. Similarly to the first embodiment, ACF, NCP, ACP, and the like, are used for the connection materials 102A and 102B. Thereupon, as shown in FIG. 8C, the first wiring substrate 72 is connected to the lower face of the selector circuit 64, which has already had the second wiring substrate 78 connected to the side face thereof, through the connection material 102A therebetween.

The method of connecting the selector circuit 64 and the first and second wiring substrates 72 and 78 is a flip-chip mount, in both cases, similarly to the first embodiment. Furthermore, the material selected for the connection material 102B that is used in the first connection should have a higher connection temperature than the connection temperature of the connection material 102A that is used in the second connection.

According to the second embodiment, by adopting the composition in which the first and second wiring substrates 72 and 78 are connected to the lower face and the side face of the selector circuit 64, respectively, then similarly to the first embodiment, it is possible to reduce the head size, and furthermore, since the wiring density of the second wiring substrate 78 can be low (i.e., the wiring pitch can be large), costs can be reduced and reliability can be improved as a result of the simplified composition of the connections.

Moreover, since the wiring is erected perpendicularly with respect to the first wiring substrate 72 without bending the FPC used as the second wiring substrate 78, then it is possible to reduce further the space occupied by the FPC.

Third Embodiment

Next, a third embodiment of the present invention is described. Below, the parts of the third embodiment that are common to the above-described first and second embodiments are not described, and the explanation focuses on the characteristic features of the third embodiment.

Figure 9:
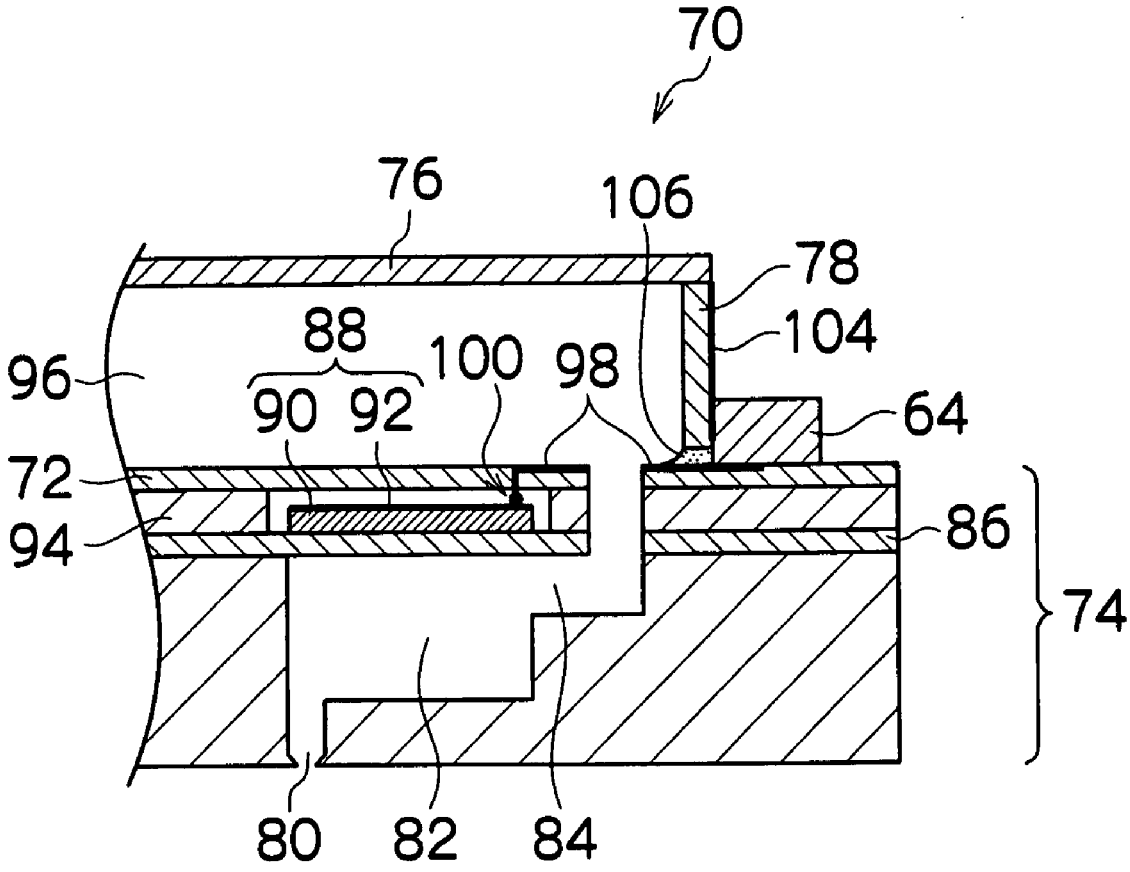
FIG. 9 is a partial cross-sectional diagram of the head according to a third embodiment.

FIG. 9 is a partial cross-sectional diagram of a head 70 according to the third embodiment. In FIG. 9, the members that are common to those in FIG. 5 are denoted with the same reference numerals. The present embodiment is a mode in which the second wiring substrate 78, which is bonded to the side face of the selector circuit 64, also serves as a side wall of the common flow channel 96, as shown in FIG. 9. The second wiring substrate 78 is provided with a connector (not shown) by which the second wiring substrate 78 is connected to external wiring, such as an FPC, through which the drive signals generated by the head driver 63 are inputted to the selector circuits 64. Wiring 104 is provided on the second wiring substrate 78. Sealing resin 106 covers over gaps between the first and second wiring substrates 72 and 78, and thereby prevents the ink inside the common flow channel 55 from leaking to the outside.

Figure 10A:
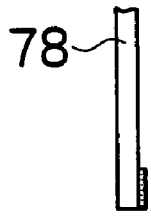
FIGS. 10A to 10D are illustrative diagrams showing a method of connecting the selector circuit according to a third embodiment.
Figure 10B:
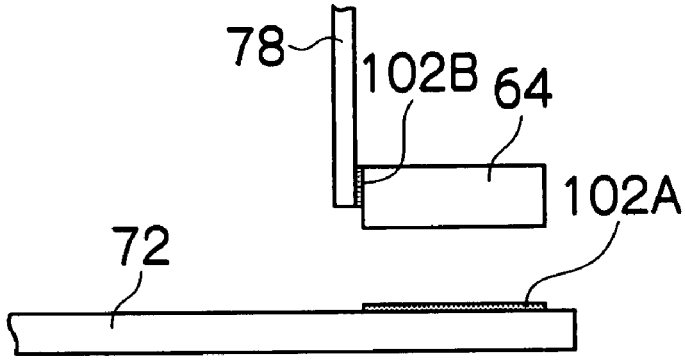
Figure 10C:
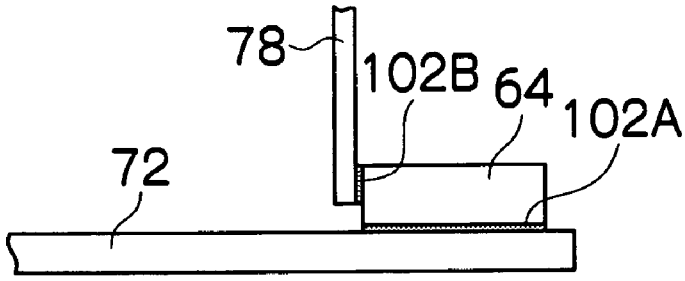
Figure 10D:
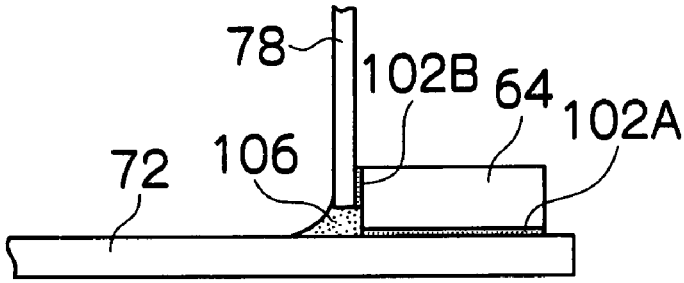

Next, the method of connecting the first and second wiring substrates 72 and 78 to the selector circuit 64 is described with reference to FIGS. 10A to 10D. Firstly, as shown in FIG. 10A, the connection material 102B is applied onto one end of the second wiring substrate 78, which also serves as the side wall of the common flow channel 96. Thereupon, as shown in FIG. 10B, the second wiring substrate 102B is connected to the side face of the selector circuit 64 through the connection material 102B therebetween, and furthermore, the connection material 102A is applied onto the first wiring substrate 72, on an end portion at a position where the selector circuit 64 is to be installed. Similarly to the first embodiment, ACF, NCP, ACP, and the like, are used for the connection materials 102A and 102B. Thereupon, as shown in FIG. 10C, the first wiring substrate 72 is connected to the lower face of the selector circuit 64, which has already had the second wiring substrate 78 connected to the side face thereof, through the connection material 102A therebetween. Finally, as shown in FIG. 10D, the sealing resin 106 is applied so as to cover over the gaps between the first and the second wiring substrates 72 and 78. A chemically resistant material (for example, epoxy resin or polyimide resin) is used as the sealing resin 106. It is desirable that the sealing resin 106 can be cured at a lower temperature than the connection temperatures of the first and second wiring substrates 72 and 78 with respect to the selector circuit 64.

According to the third embodiment, by adopting the composition in which the second wiring substrate 78 connected to the side faces of the selector circuits 64 also serves as the side wall of the common flow channel 96, the selector circuits 64 are made possible to radiate heat through the ink inside the common flow channel 96 and therefore the operation of the selector circuits 64 are stabilized, while at the same time, the heat generated by the selector circuits 64 can be used to adjust the temperature of the ink inside the common flow channel 55, and therefore ejection stability is improved.

Fourth Embodiment

Next, a fourth embodiment of the present invention is described. Below, the parts of the fourth embodiment that are common to the above-described embodiments are not described, and the explanation focuses on the characteristic features of the fourth embodiment.

Figure 11:
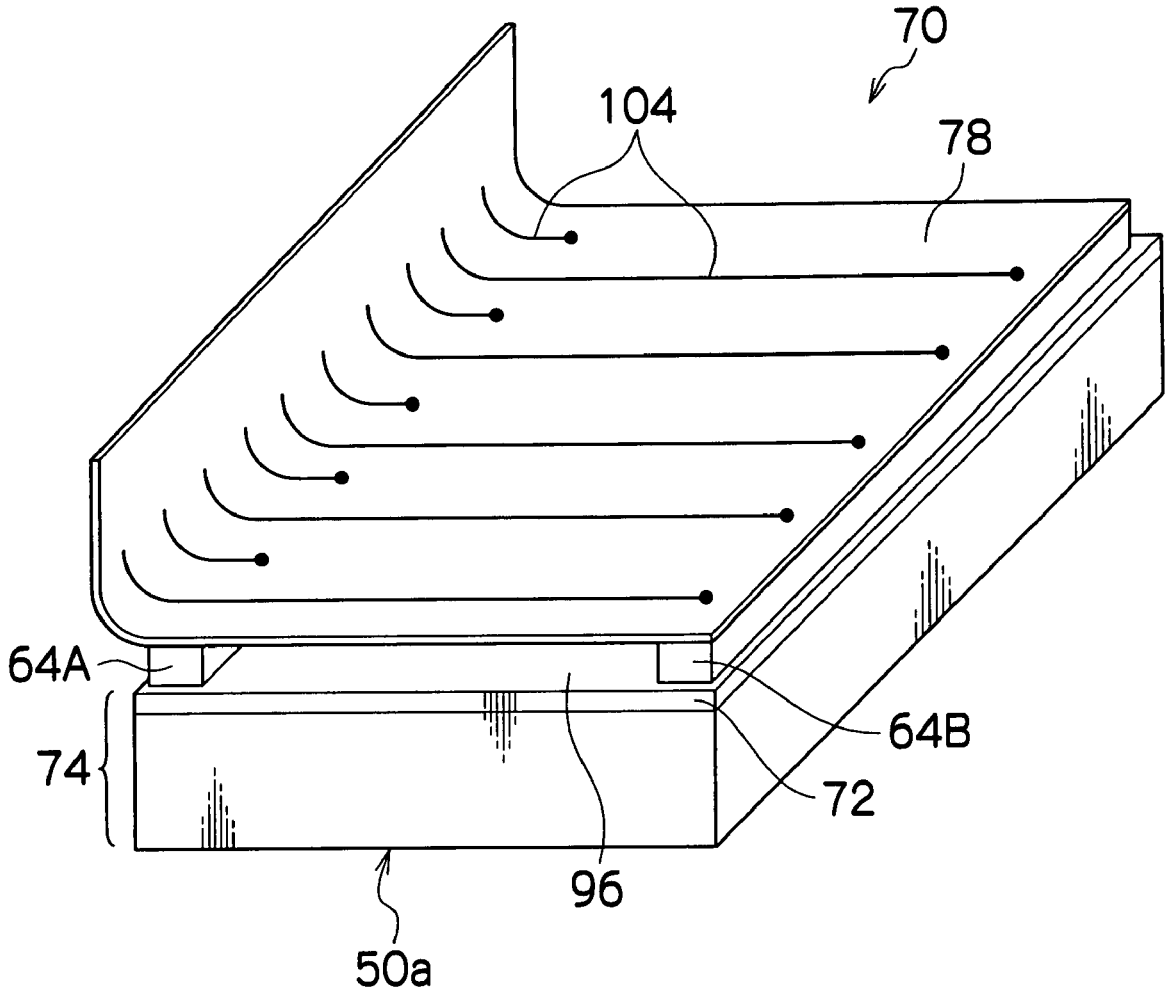
FIG. 11 is an external oblique diagram of the head according to a fourth embodiment.

FIG. 11 is an external oblique diagram of a head 70 according to the fourth embodiment. In FIG. 11, the members that are common to those in FIG. 3 are denoted with the same reference numerals. The present embodiment is a mode in which two selector circuits 64A and 64B provided on the first wiring substrate 72 constitute a right-hand side wall and a left-hand side wall of the common flow channel 96, and furthermore, the second wiring substrate 78 connected to the upper faces of the selector circuits 64A and 64B constitutes the upper wall of the common flow channel 96. The front and rear side walls of the common flow channel 96 are constituted by sealing resin (not shown).

The second wiring substrate 78 is constituted by an FPC, and as shown in FIG. 11, it has a structure in which one side of the substrate is curved. The end of the second wiring substrate 78 on the curved side is connected to the head driver 63 (not shown in FIG. 11; see FIG. 2), and the drive signals generated by the head driver 63 are inputted to the respective selector circuits 64A and 64B, through the wires 104 on the second wiring substrate 78.

The second wiring substrate 78 composed in this way also serves as a damper that reduces the pressure wave propagated through the ink inside the common flow channel 96. Therefore, it is desirable that the second wiring substrate 78 has a small thickness, and more desirably, a thickness of 10 μm or less.

Figure 12:
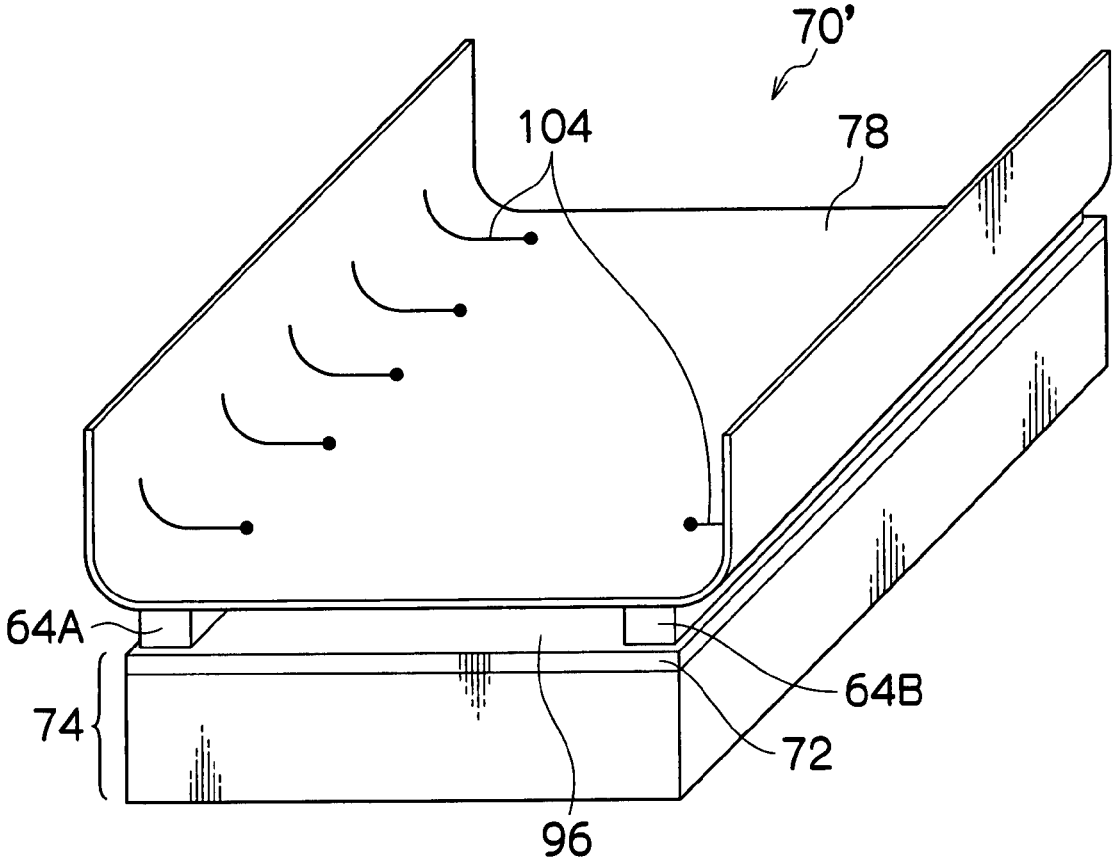
FIG. 12 is an external oblique diagram of the head according to a modification of the fourth embodiment.

FIG. 12 is an external oblique diagram of a head 70' according to a modification of the fourth embodiment. As shown in FIG. 12, it is also possible to adopt a structure in which both sides of the second wiring substrate 78 are curved. In this case, since the wires 104 of the second wiring substrate 78 can be distributed and extended on both sides of the second wiring substrate 78, then the wiring density in the second wiring substrate 78 can be lower (i.e., the wiring pitch can be larger) than in FIG. 11, and therefore manufacture becomes easier.

According to the fourth embodiment, by using the second wiring substrate 78 constituting the upper wall of the common flow channel 96 as the damper, it is possible to reduce the pressure wave propagated through the ink inside the common flow channel 96, and therefore mutual interference (liquid cross-talk) between adjacently positioned nozzles due to ink ejection can be prevented. Moreover, it is also possible to reduce costs due to the reduction in the number of components by using the member for the dual purpose. Further, it is also possible to radiate heat from the second wiring substrate 78 through the ink in the common flow channel 96, while at the same time, the temperature of the ink inside the common flow channel 96 can be adjusted, thereby improving the ejection stability. Furthermore, by adopting a composition in which a drive signal that is not sufficient to produce ejection of an ink droplet from the nozzle 80 is applied from the selector circuit 64 to the piezoelectric elements 88 when the ink is not being ejected, then it is possible further to improve the temperature adjustment effect on the ink inside the common flow channel 96.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of pressure chambers into which liquid is filled;

a plurality of nozzles which are connected to the pressure chambers;

a common flow channel which supplies the liquid to the pressure chambers;

a plurality of liquid ejection devices which cause the liquid inside the pressure chambers to be ejected through the nozzles;

a selector circuit which selects one of the liquid ejection devices to be a destination of a drive signal;

a first wiring substrate which transmits the drive signal outputted from the selector circuit to be applied to the one of the liquid ejection devices; and a second wiring substrate which transmits the drive signal to be inputted to the selector circuit, wherein the first wiring substrate is connected to a first face of a member constituting the selector circuit, and the second wiring substrate is connected to a second face of the member constituting the selector circuit, the first and second faces being different to each other, and wherein the first wiring substrate is disposed between the pressure chamber and the common flow channel.

2. An image forming apparatus comprising the liquid ejection head as defined in claim 1.

3. A liquid ejection head, comprising:

a plurality of pressure chambers into which liquid is filled;

a plurality of nozzles which are connected to the pressure chambers;

a common flow channel which supplies the liquid to the pressure chambers;

a plurality of liquid ejection devices which cause the liquid inside the pressure chambers to be ejected through the nozzles;

a selector circuit which selects one of the liquid ejection devices to be a destination of a drive signal;

a first wiring substrate which transmits the drive signal outputted from the selector circuit to be applied to the one of the liquid ejection devices; and a second wiring substrate which transmits the drive signal to be inputted to the selector circuit, wherein the first wiring substrate is connected to a first face of a member constituting the selector circuit, and the second wiring substrate is connected to a second face of the member constituting the selector circuit, the first and second faces being different to each other, and wherein the second wiring substrate constitutes a wall of the common flow channel.

4. An image forming apparatus comprising the liquid ejection head as defined in claim 3.

5. A liquid ejection head, comprising:

a plurality of pressure chambers into which liquid is filled;

a plurality of nozzles which are connected to the pressure chambers;

a common flow channel which supplies the liquid to the pressure chambers;

a plurality of liquid ejection devices which cause the liquid inside the pressure chambers to be ejected through the nozzles;

a selector circuit which selects one of the liquid ejection devices to be a destination of a drive signal;

a first wiring substrate which transmits the drive signal outputted from the selector circuit to be applied to the one of the liquid ejection devices; and a second wiring substrate which transmits the drive signal to be inputted to the selector circuit, wherein the first wiring substrate is connected to a first face of a member constituting the selector circuit, and the second wiring substrate is connected to a second face of the member constituting the selector circuit, the first and second faces being different to each other, and wherein the member constituting the selector circuit constitutes a wall of the common flow channel.

6. An image forming apparatus comprising the liquid ejection head as defined in claim 5.

* * * * *

UNITED STATES PATENT AND TRADEMARK OFFICE

CERTIFICATE OF CORRECTION

PATENT NO. : 7,819,502 B2
APPLICATION NO. : 11/716570
DATED : October 26, 2010
INVENTOR(S) : Katsumi Enomoto et al.

It is certified that error appears in the above-identified patent and that said Letters Patent is hereby corrected as shown below:

ON THE TITLE PAGE:

At item (73), Assignee, change:

"(73) Assignee: Fujifilm Corporation, Tokyo (JP)"

to

--(73) Assignees: Fujifilm Corporation, Tokyo (JP); Fuji Xerox Co., Ltd., Tokyo (JP)--.

Signed and Sealed this
Twentieth Day of September, 2011

David J. Kappos

David J. Kappos
*Director of the United States Patent and Trademark Office*